US007188872B2

(12) United States Patent
Kalargeros et al.

(10) Patent No.: US 7,188,872 B2
(45) **Date of Patent: *Mar. 13, 2007**

(54) LATCH MECHANISM

(75) Inventors: Nick Kalargeros, Stoke (GB); Nigel Spurr, Hall Green (GB); Veronique Mejean, Kings Norton (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/915,963

(22) Filed: Aug. 11, 2004

(65) Prior Publication Data

US 2005/0017517 A1 Jan. 27, 2005

Related U.S. Application Data

(63) Continuation of application No. 09/815,959, filed on Mar. 23, 2001, now Pat. No. 6,789,825.

(30) Foreign Application Priority Data

Mar. 23, 2000 (GB) ..... 0006932.8

(51) Int. Cl.
*E05C 3/16* (2006.01)
*E05B 65/32* (2006.01)

(52) U.S. Cl. ..... 292/216; 292/DIG. 23; 292/DIG. 56; 292/DIG. 57

(58) Field of Classification Search ..... 292/216, 292/201, 213, DIG. 23, DIG. 56, DIG. 57, 292/341.12
See application file for complete search history.

(56) References Cited

U.S. PATENT DOCUMENTS 4,067,605 A * 1/1978 Green et al. ..... 296/218
4,120,524 A * 10/1978 Buck, Jr. ..... 292/263
4,216,983 A * 8/1980 Hough et al. ..... 292/263
4,358,141 A * 11/1982 Hamada ..... 292/216
4,756,564 A * 7/1988 Ikeda ..... 292/216
4,783,103 A * 11/1988 Schlegel ..... 292/216
4,854,617 A 8/1989 Hayakawa et al.

(Continued)

FOREIGN PATENT DOCUMENTS

DE 2 320 351 10/1974

(Continued)

OTHER PUBLICATIONS

European Search Report Jul. 3, 2001.

(Continued)

*Primary Examiner*—Brian E. Glessner
*Assistant Examiner*—Carlos Lugo
(74) *Attorney, Agent, or Firm*—Carlson, Gaskey, & Olds

(57) ABSTRACT

A latch mechanism comprises a latch bolt rotatably mounted about a pivot on a chassis. The latch bolt is movable from an open condition, in which it is free to receive a striker of a motor vehicle, to a closed condition in which the striker is retained by the latch bolt. The latch bolt comprises an overmold of elastomeric material, which defines first, second and third buffers. The third buffer is adapted to cooperate with an abutment on the chassis to absorb over-travel of the striker when the door of a motor vehicle carrying the latch mechanism is closed.

15 Claims, 2 Drawing Sheets

U.S. PATENT DOCUMENTS

| | | | | | |
|---|---|---|---|---|---|
| 4,971,373 | A | * | 11/1990 | Hamada et al. | 292/216 |
| 5,020,838 | A | | 6/1991 | Fukumoto | |
| 5,192,103 | A | | 3/1993 | Fukumoto et al. | |
| 5,308,128 | A | * | 5/1994 | Portelli et al. | 292/216 |
| 5,348,357 | A | * | 9/1994 | Konchan et al. | 292/216 |
| 5,457,913 | A | * | 10/1995 | Gold | 49/381 |
| 5,632,517 | A | | 5/1997 | Paulik et al. | |
| 5,642,636 | A | | 7/1997 | Mitsui | |
| 6,419,286 | B1 | | 7/2002 | Szablewski | |
| 2005/0062295 | A1 | * | 3/2005 | Ketelsen et al. | 292/216 |

FOREIGN PATENT DOCUMENTS

| | | | |
|---|---|---|---|
| EP | 0 808 978 A2 | | 11/1997 |
| EP | 0 995 870 | | 4/2000 |
| IT | EP 894925 | * | 3/1999 |
| IT | EP 894927 | * | 3/1999 |
| IT | EP 995870 | * | 4/2000 |
| IT | EP1160121 | * | 5/2001 |
| JP | 4131484 | * | 4/1992 |
| JP | 4143390 | * | 4/1992 |
| JP | 4161579 | * | 4/1992 |
| JP | 5079233 | * | 3/1993 |
| JP | 5156854 | * | 5/1993 |
| JP | 2003113687 | * | 4/2003 |

OTHER PUBLICATIONS

Opposition by the company Huf Hulsbeck & Fust GmbH & Co. against EP 1 136 640B1 (in German).

Opposition by the company Huf Hulsbeck & Fust GmbH & Co. against EP 1 136 640B1 (English translation).

* cited by examiner

LATCH MECHANISM

This application is a Continuation of U.S. patent application Ser. No. 09/815,959 filed on Mar. 23, 2001 now U.S. Pat. No. 6,789,825.

BACKGROUND OF THE INVENTION

The present invention relates to a latch mechanism. The latch mechanism is primarily, but not exclusively, intended for use on a door of a motor vehicle.

It is known for a motor vehicle latch mechanism to have on a latch bolt thereof, incorporated into an over-mold, a first low energy buffer and a second low energy buffer. Such low energy buffers lower the noise of operation of the latch mechanism. In particular, the first low energy buffer can absorb some of the impact between the latch bolt and an open latch abutment as the latch bolt moves under a spring bias into its open condition. When a latch bolt moves into a closed condition, in which the latch bolt retains a striker mounted on the door frame of the motor vehicle, a pawl moves past a first safety abutment of the latch bolt and is spring biased to engage the latch bolt at a closed abutment to maintain its closed condition. The second low energy buffer can absorb some of the impact between the pawl and that portion of the latch bolt between the first safety abutment and the closed abutment as the pawl, under its spring bias, moves to engage the closed abutment.

When a motor vehicle door is closed, the striker on the door frame engages the latch mechanism. The force of closing the door gives rise to over-travel of the door and hence the latch beyond the closed position.

To absorb, and limit to an extent, over-travel, it is known to provide a separate buffer, mounted on a chassis of the latch mechanism in the line of movement of the closing latch bolt. Such a high energy buffer is designed to absorb much higher impact than the first and second low energy buffers of the latch bolt. Due to its large size and other requirements its has been considered necessary to mount the high energy buffer separately on the chassis at additional cost and assembly time.

SUMMARY OF THE INVENTION

An aim of the invention is to provide a latch mechanism having a simplified over-travel buffer arrangement.

Thus according to the present invention there is provided a latch mechanism suitable for a vehicle, the latch mechanism comprising a chassis, and a latch bolt, the latch bolt being movably mounted on the chassis, the latch bolt having an over-mold thereon, the overmold defining a buffer, the chassis also comprising an abutment for the buffer, the latch bolt being moveable between an open position in which it can receive a striker of a vehicle, a closed position in which the striker is capable of being retained by the latch bolt, and an over-travel position in which the striker is in an over-travel position relative to the latch chassis, wherein the buffer is adapted to co-operate with the abutment to absorb over-travel of the latch bolt.

In that way, there is no need for a separate over-travel buffer on the chassis and the cost and assembly time associated with it. Should the latch bolt also require low energy buffers the overmold can be molded to incorporate all the different types of buffers. That is preferable to having a combination of buffers on the chassis and buffers on the latch bolt.

The applicant is the first to realize that it is possible to provide a single overmolding on a latch bolt that is capable of absorbing high energy associated with over-travel of the associated door and also low energy impacts associated with various relatively moving components of the latch mechanism.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
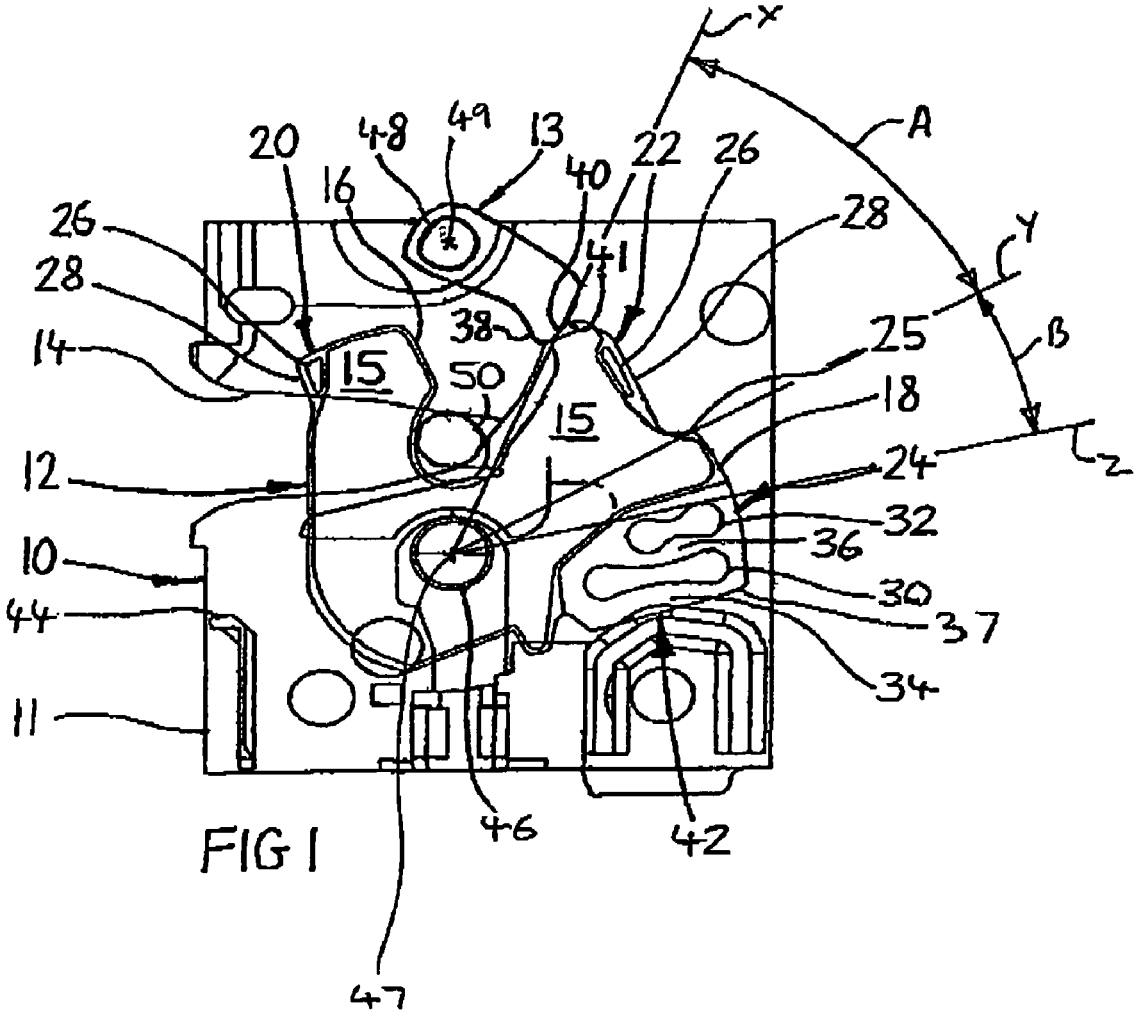
FIG. 1 shows a side view of a latch mechanism in accordance with the invention.

Referring to FIG. 1, a latch mechanism 10 comprises a chassis 11 having a latch bolt 12 and a retaining means in the form of a pawl 13 mounted thereon. The chassis 11 is in the form of a plate. A slot 14 known as a fish mouth is defined on the chassis 11. The latch bolt 12 comprises two arms 15 which define a recess 16.

The latch bolt 12 has a overmold 18. The overmold 18 is formed of elastomeric material. The overmold 18 comprises a first buffer 20, a second buffer 22 and a third buffer 24. It is immediately noticeable from FIG. 1 that the third buffer 24 is much larger than the first and second buffers 20, 22. The first buffer 20 comprises a small cavity 26 bound by a small loop 28 of the overmold 18. The second buffer 22 is similarly formed. The third buffer 24 comprises a first large cavity 30 and a second large cavity 32, the cavities 30, 32 being bound by successive first and second large loops 34, 36 of the overmold 18.

The first and second large cavities 30, 32 are of elongate form. The ends of each large cavity 30, 32 are of increased width and rounded so as to confer a bone shaped appearance to the large cavities 30, 32 in cross section. The first large cavity 30 is longer than the second large cavity 32.

Figure 2:
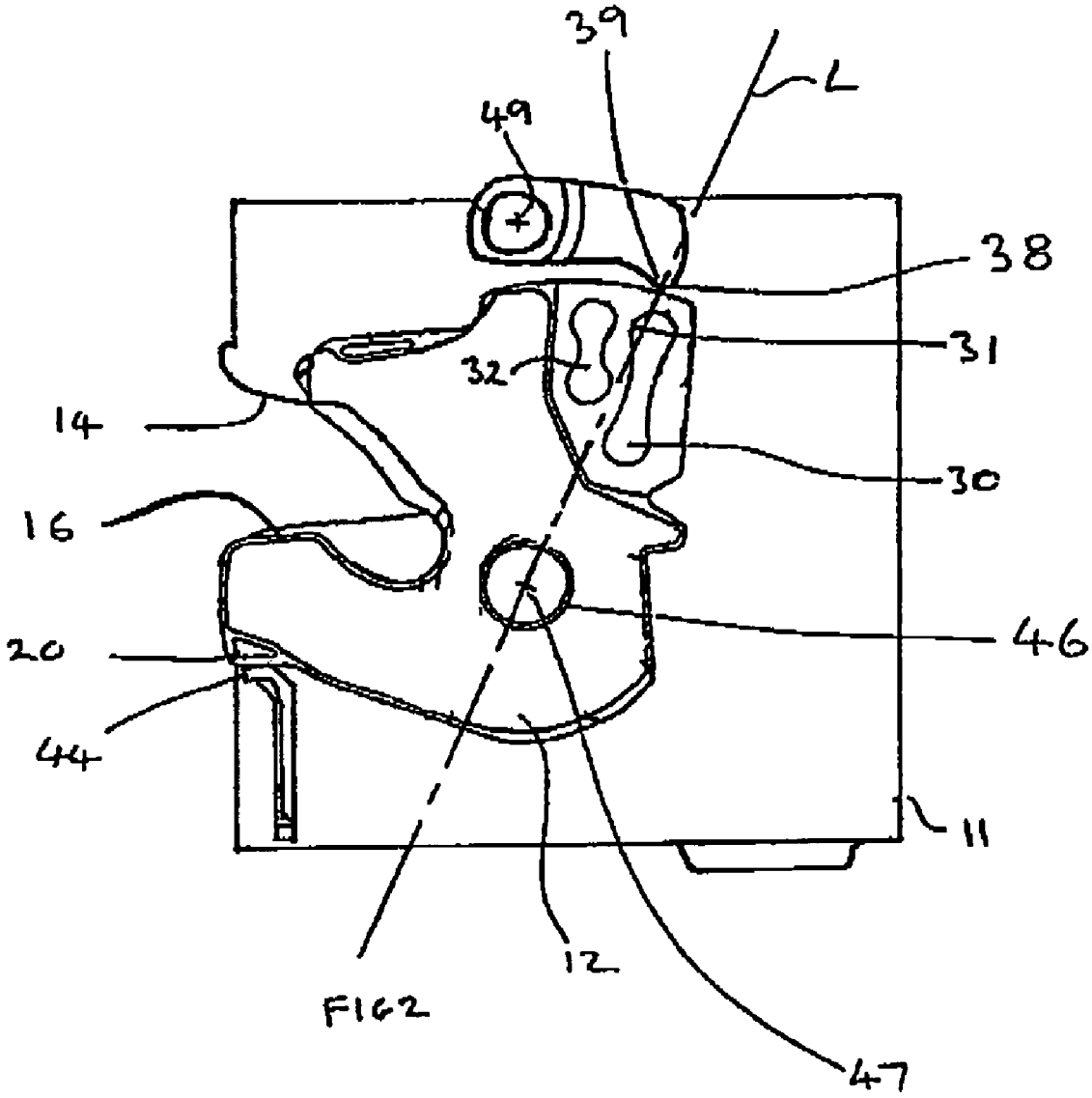
FIG. 2 shows the latch mechanism of FIG. 1 illustrating selected components of the latch mechanism in a latch open position.

As shown in FIGS. 1 and 2, the pawl 13 comprises an impact surface 38 and an engaging surface 40 defining a pawl tooth 39. The latch bolt 12 has a closed abutment 41 adapted to engage the engaging surface 40 of the pawl 13. The latch bolt 12 comprises a first safety abutment 25 at its periphery between the recess 16 and the third buffer 24.

The chassis 11 comprises an over-travel abutment 42 and an open latch abutment 44. The latch bolt 12 is rotatably mounted at a first pivot 46 having a first pivot axis 47 on the chassis 11. The pawl 13 is rotatably mounted at a second pivot 48 having a second pivot axis 49 on the chassis 11. The latch bolt 12 is biased by biasing means counter clockwise about the first pivot 46 as shown in FIG. 1. The pawl 13 is biased by further biasing means clockwise about second pivot 48 as shown in FIG. 1. As shown, lines X, Y, and Z are radially orientated to first pivot axis 47 of first pivot 46 with line X passing through closed abutment 41, line Y passing through the first safety abutment 25, and line Z passing through an edge of cavity 32. Angle A is formed between lines X and Y, and angle B is formed between lines Y and Z. As shown, angle A is greater than angle B.

It will be appreciated that the first buffer 20 is at the same radial distance from pivot 46 as open latch abutment 44, i.e. it is rotationally in line with the open latch abutment 44, the open latch abutment 44 lying counter clockwise of the first buffer 20 as shown in FIG. 1. It will also be appreciated that the third buffer 24 is rotationally in line with the over-travel abutment 42, the over-travel abutment 42 lying clockwise of the third buffer 24 as shown in FIG. 1.

In use the latch mechanism 10 is mounted on the door of a motor vehicle. A striker indicated at 50 is fixed on a door frame of the motor vehicle and is aligned with the slot 14. In an open position of the latch bolt mechanism 10 as shown in FIG. 2, the latch bolt 12 is biased against the open latch abutment 44 so that the recess 16 aligns with the slot 14, ready to receive the striker 50. A line L extends between the first pivot axis 47 and the pawl tooth 39 with the entire cavity 32 positioned to the left of line L and a portion 31 of cavity 30 also sitting to the left of line L as shown.

As the door of the motor vehicle is closed the relative movement between the striker 50 and the latch mechanism 12 causes the striker to move into the fishmouth slot 14 and the recess 16 of the latch bolt 12 and pushes the latch bolt about the first pivot 46. A leading edge 37 of the third buffer 24 hits the impact surface 38 of the pawl 13 and displaces the pawl counter clockwise as shown in FIG. 1 against its bias. It will be appreciated that with the impact being between the edge of the third buffer 24 and the metal of the impact surface 38, noise of the impact is reduced with respect to the known metal-metal impact.

The aforementioned impact rotates the pawl 13 counter clockwise sufficiently for the pawl 13 to move relatively along the periphery of the latch bolt 12, as the latch bolt 12 moves clockwise beneath the pawl 13, with the pawl 13 jumping past the first safety abutment 25 and moving clockwise (as in FIG. 1) under its bias, to strike the second buffer 22. The second buffer 22 absorbs some of the energy of the impact.

The latch bolt 12 continues to rotate clockwise until the third buffer 24 hits the over-travel abutment 42. The over-travel abutment 42 deforms the third buffer 24. The first and second large loops 34, 36 are pressed together closing the cavities 30, 32 and absorbing the impact.

The further biasing means mentioned earlier, biases the pawl 13 clockwise as shown in FIG. 1 so that the engaging surface 40 of the pawl 13 engages the closed abutment 41 of the latch bolt 12. In that way the latch bolt 12 is not free to rotate under its biasing means into its open condition.

When the pawl 13 is lifted, the engaging surface 40 moves out of the recess 16 to allow the latch bolt 12 to rotate counter clockwise under its bias until the first buffer 20 contacts the open latch abutment 44 thereby returning the latch mechanism to its open position. The first buffer 20 absorbs some of the kinetic energy of the latch bolt 12 when the latch bolt 12 rotates from the closed position (shown in FIG. 1) to the open position described above.

The impact on the third buffer 24 is many times the impact on the first and second buffers 20, 22. The applicant is the first to realize that the different magnitudes of impact on the first, second and third buffers 20, 22, 24 can be accommodated by the use of a single overmold. It is clear that the third buffer 24 may comprise any number of independently moveable buffer parts and may comprise any number of cavities.

While the invention has been described with reference to a rotary latch bolt 12, it could easily be applied to a linear latch bolt.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A latch mechanism suitable for a vehicle comprising:

a chassis having an over-travel abutment;

a latch bolt being movably mounted on said chassis, said latch bolt being moveable between an open position in which said latch bolt can receive a striker of a vehicle, a closed position in which said striker is capable of being retained by said latch bolt, and an over-travel position in which said striker is in an over-travel position relative to said chassis; and an overmold disposed on said latch bolt and defining a buffer for contact wit the over-travel abutment due to over-travel of said latch bolt, wherein the buffer is a buffer of the latch bolt for absorbing over-travel energy, the buffer comprising at least a first cavity having first and second ends and an intermediate portion between the first and second ends, wherein a width of said first and second ends are greater than a width of the intermediate portion, and wherein at least a portion of the intermediate portion closes before said first and second ends when the buffer contacts the over-travel abutment.

2. The latch mechanism as recited in claim 1, wherein said first cavity does not reach a periphery of said overmold.

3. The latch mechanism as recited in claim 2, wherein said first cavity is elongate.

4. The latch mechanism as recited in claim 3, wherein said first cavity is adapted so that a longitudinal axis is substantially perpendicular to a direction of engagement of said buffer with said over-travel abutment when said over-travel abutment is in contact with said buffer.

5. The latch mechanism as recited in claim 1, wherein said first cavity has a single inner surface which is substantially continuously curved.

6. The latch mechanism as recited in claim 1, wherein ends of said first cavity are partially substantially circular such that said cavity is bone shaped.

7. The latch mechanism as recited in claim 1, wherein said buffer comprises a second cavity substantially similar in shape to said first cavity.

8. The latch mechanism as recited in claim 7, wherein said first cavity is proximal said over-travel abutment and is substantially larger than said second cavity which is remote from said over-travel abutment.

9. The latch mechanism as recited in claim 1, wherein said overmold is formed by an elastomeric material.

10. The latch mechanism as recited in claim 1, wherein said buffer is adapted to displace a retaining member as said latch bolt moves from said open position to said closed position.

11. The latch mechanism as recited in claim 1, wherein said overmold comprises a further buffer adapted to absorb an impact between a further component of the latch mechanism and said latch bolt.

12. The latch mechanism as recited in claim 11, wherein said further component is an open latch abutment of said chassis which is contacted by said further buffer as said latch bolt position moves to said open position.

13. The latch mechanism as recited in claim 11, wherein said further component is a pawl, said pawl engaging said latch bolt when the latch bolt moves to a closed position, said further buffer being positioned between a closed abutment of said latch bolt and a first safety abutment of said latch bolt.

14. A latch mechanism suitable for a vehicle comprising:

a chassis having an over-travel abutment;

a latch bolt that is rotatable about a pivot having a pivot axis and that is movably mounted on the chassis between an open position where the latch bolt can receive a striker of the vehicle, a closed position in which the latch bolt can retain the striker, and an over-travel position in which the striker is in an over-travel position relative to the chassis;

an overmold disposed on the latch bolt and defining a buffer for cooperation with the over-travel abutment to absorb over-travel energy of the latch bolt, wherein the buffer comprises a cavity where ends of the cavity have a larger width than an intermediate portion of the cavity; and a pawl having a pawl tooth operable to retain the latch bolt in one of the closed position and a first safety position, wherein movement of the latch bolt to the open position causes at least a portion of the cavity to move past a line passing through the pivot axis and the pawl tooth.

15. The latch mechanism as recited in claim 14 wherein movement of the latch bolt to the open position causes the entire cavity to move past a line passing through the pivot axis and the pawl tooth.

* * * * *

UNITED STATES PATENT AND TRADEMARK OFFICE

CERTIFICATE OF CORRECTION

PATENT NO. : 7,188,872 B2
APPLICATION NO. : 10/915963
DATED : March 13, 2007
INVENTOR(S) : Kalargeros et al.

It is certified that error appears in the above-identified patent and that said Letters Patent is hereby corrected as shown below:

Claim 1, Column 4, line 24: “wit” should be --with--

Signed and Sealed this

Twenty-second Day of May, 2007

JON W. DUDAS
*Director of the United States Patent and Trademark Office*